US007552714B2

(12) United States Patent
Maier et al.

(10) Patent No.: US 7,552,714 B2
(45) Date of Patent: Jun. 30, 2009

(54) IGNITION DEVICE FOR AN INTERNAL COMBUSTION ENGINE AND METHOD FOR ITS OPERATION

(75) Inventors: Georg Maier, Kernen i.R. (DE); Wolfgang Layher, Besigheim (DE); Thomas Neumaier, Waiblingen (DE); Eberhard Schieber, Backnang (DE); Mohamed Abou-Aly, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/838,606

(22) Filed: Aug. 14, 2007

(65) Prior Publication Data

US 2008/0053407 A1 Mar. 6, 2008

(30) Foreign Application Priority Data

Aug. 16, 2006 (DE) ..... 10 2006 038 276

(51) Int. Cl.
*F02P 5/06* (2006.01)
*F02P 5/00* (2006.01)

(52) U.S. Cl. ..... 123/406.58

(58) Field of Classification Search ..... 123/618, 123/406.58, 406.59, 406.65; 290/41, 40 R
See application file for complete search history.

(56) References Cited

U.S. PATENT DOCUMENTS 3,286,164 A * 11/1966 De Huff ..... 324/378
3,577,971 A * 5/1971 Cavil ..... 123/598
5,392,747 A * 2/1995 Nickel et al. ..... 123/406.56
6,606,552 B2 * 8/2003 Haimerl et al. ..... 701/115
6,830,015 B2 * 12/2004 Venturoli et al. ..... 123/41 E
2002/0112536 A1 * 8/2002 Shimoyama et al. ..... 73/117.3
2002/0173902 A1 * 11/2002 Haimerl et al. ..... 701/115
2003/0051684 A1 * 3/2003 Laydera-Collins ..... 123/73 AA
2003/0111024 A1 * 6/2003 Venturoli et al. ..... 123/41 E

* cited by examiner

*Primary Examiner*—Mahmoud Gimie
(74) *Attorney, Agent, or Firm*—Gudrun E. Huckett

(57) ABSTRACT

An ignition device for a motor unit with an internal combustion engine provided with a piston, a combustion chamber with a spark plug, a crankshaft driven by the piston, an intake port supplying combustion air to the combustion chamber, an exhaust for removing combustion gases from the combustion chamber, a signal generator driven by the crankshaft and emitting for one crankshaft revolution an alternating voltage signal, has an ignition unit that triggers a spark at the spark plug at a preselectable timing. The ignition unit is a module separate from the motor unit. An alternating voltage signal generated by the signal generator is supplied to the ignition unit as an information signal sufficient for operating the internal combustion engine. The alternating voltage signal is supplied to a first unit for energy processing and to a second unit for processing information for control of the internal combustion engine.

37 Claims, 6 Drawing Sheets

IGNITION DEVICE FOR AN INTERNAL COMBUSTION ENGINE AND METHOD FOR ITS OPERATION

BACKGROUND OF THE INVENTION

The invention relates to an ignition device for a motor unit comprising an internal combustion engine, in particular for a motor unit with a two-stroke engine of a portable hand-held power tool. The internal combustion engine of the motor unit comprises a piston, a combustion chamber with a spark plug, a crankshaft that is driven in rotation by the piston, an intake port for supplying combustion air into the combustion chamber, an exhaust for removing combustion gases from the combustion chamber, as well as a signal generator driven in rotation by the crankshaft and attached to the motor unit and emitting for one crankshaft revolution sequential alternating voltage signals to an ignition unit that triggers a spark at the spark plug at a preselectable timing.

Modern internal combustion engines as they are used in connection with hand-held portable power tools such as motor chain saws, trimmers, cut-off machines, blowers or similar devices are controlled by ignition devices that, in addition to the alternating voltage signal for high-voltage supply of a spark plug, must have an ignition trigger for triggering ignition that is to be arranged at approximately 40 degrees before top dead center. The ignition trigger must be attached circumferentially relative a revolving pole wheel on the crankcase in a precise rotational position wherein, in mass production of such engines, fluctuations with regard to mechanical arrangement of the ignition trigger occur that can impair ignition timing. Moreover, the constructively fixed arrangement of the ignition generator, ignition module as well as engine speed sensor is troublesome because these parts are often arranged within the cooling air passage at the fan wheel and occupy space in the cooling air passage. This can cause cooling problems so that the cylinder is thermally stressed to a greater extent.

SUMMARY OF THE INVENTION

It is an object of the present invention to simplify an ignition device in such a way that, independent of its configuration, a precise ignition is possible; a method for operating such an ignition device is to be provided also.

In accordance with the present invention, this is achieved in that the ignition unit is a module that is separate from the motor unit, in that the electric alternating voltage signal of the signal generator is supplied to the ignition unit as an information signal sufficient for operation of the internal combustion engine, and in that the alternating voltage signal is supplied to a unit for energy processing and to a unit for processing information for control of the internal combustion engine.

The ignition unit is embodied separately from the motor unit wherein the signal generator, advantageously embodied as an alternating current generator (alternator), is connected by only one electric line to the ignition unit. As the only information signal that is sufficient for operating the internal combustion engine, the alternating voltage signal of the signal generator of the ignition unit is supplied and processed in a unit for energy processing as well as in a unit for processing angle information.

The information signal sufficient for operating the internal combustion engine is preferably a processed angle information signal that serves for providing a correct angle position correlation of the mechanical crankshaft angle position to the alternating voltage signal.

By means of this configuration it is possible to arrange the ignition unit at any location on the internal combustion engine or the motor unit; it is only required to make available the alternating voltage signal to the ignition unit. The ignition unit is then to be connected by means of an appropriate high-voltage cable to the spark plug of the internal combustion engine. Angle-of-rotation sensors or similar devices for recognizing the angle-of-rotation position of the crankshaft are no longer needed. The actual mechanical crankshaft angle position is electronically determined based on the alternating voltage signal of the generator and, once the actual mechanical crankshaft position is determined, is fixedly assigned to the alternating voltage signal of the crankshaft revolution. This "locking" of the alternating voltage signal to the actual mechanical rotary position of the crankshaft can be realized already during the first crankshaft revolution because the angle information signal derived from the alternating voltage signal has characteristic features that can be correlated to constructively predetermined crankshaft angles. For example, opening of the exhaust or opening of the transfer passage imprints a distinct or characteristic feature onto the angle information signal so that based on these distinct features the ignition unit, while the crankshaft still performs its first crankshaft revolution, can provide a fixed assignment of the alternating voltage signal to the actual mechanical crankshaft angle. Once the alternating voltage signal has been locked to the crankshaft angle position, it is only necessary to count the sequential zero crossings that, based on the configuration of the alternating current generator, occur sequentially at known crankshaft angle spacings.

Because of the substantial decoupling of the signal generator and the ignition unit, new possibilities for the arrangement of the ignition unit are made available. The ignition unit can now be arranged at locations that could not be used in known configurations. Moreover, when the ignition unit is split into component modules, the high-voltage unit, for example, can be arranged proximal to the spark plug or can be integrated into the spark plug, while the processor unit can be positioned at a thermally advantageous location, for example, on the side of the crankcase that is facing away from the cylinder (crankcase sump).

By eliminating the angle-of-rotation sensor for recognizing the actual mechanical crankshaft angle position, the mechanical configuration of the ignition device itself is simplified; this also leads to a more precise ignition action because mechanical tolerance errors resulting during assembly of an angle-of-rotation sensor are no longer present. Each system of a produced series calibrates itself in operation so that, for example, in mass production of hand-held power tools, each individually produced device works optimally as a result of self-calibration.

The angle information signal itself is comprised of sequential zero crossings of the preferably continuous alternating voltage signal wherein these zero crossings are preferably uniformly distributed across a crankshaft revolution.

The spacing between two zero crossings creates a zero position interval wherein, in a particular embodiment of the invention, for each zero position interval the interval engine speed is determined. The thus calculated interval engine speeds provide an engine speed course that provides the angle information signal based on which the alternating voltage signal can be locked on the actual mechanical crankshaft angle position.

Locking of the alternating voltage signal on the mechanical crankshaft angle position can be done always at the time when the processed angle information signal exhibits a distinct feature that is fixedly correlated with a certain known mechanical angle position of the crankshaft.

In an expedient embodiment, a zero position interval corresponds to the n-th portion of a crankshaft revolution wherein n is an integer greater than 6. Preferably, the number n is between 6 and 24, in particular, it is 12. Twelve zero crossings correspond to six periods T of an alternating voltage signal wherein a period T corresponds to 60 degrees crank angle (° CA).

For simplifying locking of the alternating voltage signal on the mechanical crankshaft angle position, advantageously the rotational position of the alternating current generator on the machine unit and the top dead center of the piston are adjusted relative to one another such that a zero crossing interval is symmetrically positioned to the top dead center of the piston. Expediently, the adjustment is such that a zero crossing of the induced alternating voltage signal is preferably approximately 15° CA before top dead center of the piston. In this way, it is also achieved that, when starting the internal combustion engine, a branch of the half wave can be used as a voltage supply for the electronics so that the system is operational during start of the engine at an early point in time even without a battery. This provides for beneficial starting conditions. The adjustment can also be done such that the course of minimal engine speed is within the average value. In this way, a minimal interval engine speed can be determined in a simple way that provides as a significant feature the top dead center of the piston. It can be expedient to differentiate the engine speed course of the interval engine speed, i.e. the angle information signal; in this way, the differential curve exhibits distinct hooks that can be correlated to a characteristic mechanical crankshaft angle position, for example, the top dead center of the piston.

In the illustrated embodiment, a claw pole alternator or a radial alternator is used as a signal generator; such an alternator is of a simple configuration and requires little space. The stator of the alternator is expediently secured on the crankcase while the rotating magnet ring is fixedly connected to a fan wheel of the internal combustion engine.

The energy generated by the alternator serves not only for supplying the ignition unit and the high-voltage unit of the ignition unit with electric energy but also for supplying a heating device such as a carburetor heater, a handle heater or similar devices. By means of external connectors it is also possible to connect light sources, target lasers for cut-off machines or similar consumers. In a further embodiment of the invention, energy of the alternating voltage signal can also be used for charging energy storage devices such as capacitors, accumulators or similar devices. The total energy of the alternating voltage signal can be divided as needed onto individual consumers and the ignition wherein it is possible to set supply priorities. For example, the ignition receives energy at priority level 1; only when the ignition has sufficient energy for safe operation of the internal combustion engine, other consumers of priority levels 2, 3 etc. are supplied with energy. An embodiment of the alternator with at least two coils is also advantageous, wherein one of the coils is used for supplying a first consumer such as a high-voltage supply and the other coil for supplying a second different consumer, for example, the ignition or a heater.

When electric consumers are operated at the alternator, it is advantageous for an unequivocal position determination of a zero crossing of the voltage signal to stop or interrupt current flow by a connected electrical load at the time when the zero crossing occurs. In this way, signal displacements caused by inductivity or capacitance are safely prevented. It was found to be advantageous to stop or interrupt current flow, e.g. by switching off, in the angle range of from approximately 5 ° CA before zero crossing to approximately 1° CA after zero crossing.

The ignition unit is comprised advantageously of a control unit such as a microprocessor or the like as well as a high-voltage unit as a separate unit from the control unit. In this way, the control unit can be arranged separate from the high-voltage unit in a thermally advantageous area of the power tool. Expediently, an arrangement on or near a component of the motor unit is provided. For example, the control unit can be arranged at the mixture processing device such as a carburetor. The motor unit is expediently connected together with the carburetor by means of antivibration elements to the housing of the power tool wherein the carburetor advantageously is connected by means of an elastic channel resiliently to the internal combustion engine. An arrangement of the control unit on the carburetor housing has the advantage of vibration decoupling because the carburetor is decoupled by means of antivibration elements from the housing and, because of the elastic connection to the internal combustion engine, is therefore vibration decoupled from it. In this way, a vibration decoupled arrangement of the electronic control unit is achieved without the electric connecting lines to the high-voltage unit or to the alternator having to be extended across the antivibration gap. A thermally beneficial arrangement is provided that is also vibration-resistant and soiling-resistant.

Alternatively, the arrangement of the control unit can also be realized at or near the crankcase, for example, near the alternator below the cylinder. An advantageous position is also provided at the part of the crankcase that is facing away from the cylinder, i.e., at the bottom of the crankcase.

According to the present invention, a method is provided for processing a preferably continuous alternating voltage signal of a signal generator driven by a shaft of the internal combustion engine in order to correlate to the rotating shaft an angle information signal in a correct angle position. For this purpose, the generator (alternator) is designed such that the constructively provided spacing between the zero crossings of the alternating voltage signal corresponds to the n-th portion of a complete shaft revolution wherein n is an integer. The time interval between sequential zero crossings is detected and for a zero position interval of sequential zero crossings an interval engine speed is determined. The engine speed values of the interval engine speeds are plotted against the shaft angle and provide an engine speed course which provides an angle information signal for the mechanical angle position of the shaft.

This engine speed course is scanned for an engine speed minimum wherein the engine speed minimum is correlated with the angle position of the crankshaft at top dead center of the piston. Under certain operating conditions, for example, in the case of torsional vibrations or in the case of an engine start at very low engine speed ("sputtering"), it is expedient to check this correlation.

DESCRIPTION OF THE PREFERRED EMBODIMENTS

Figure 1:
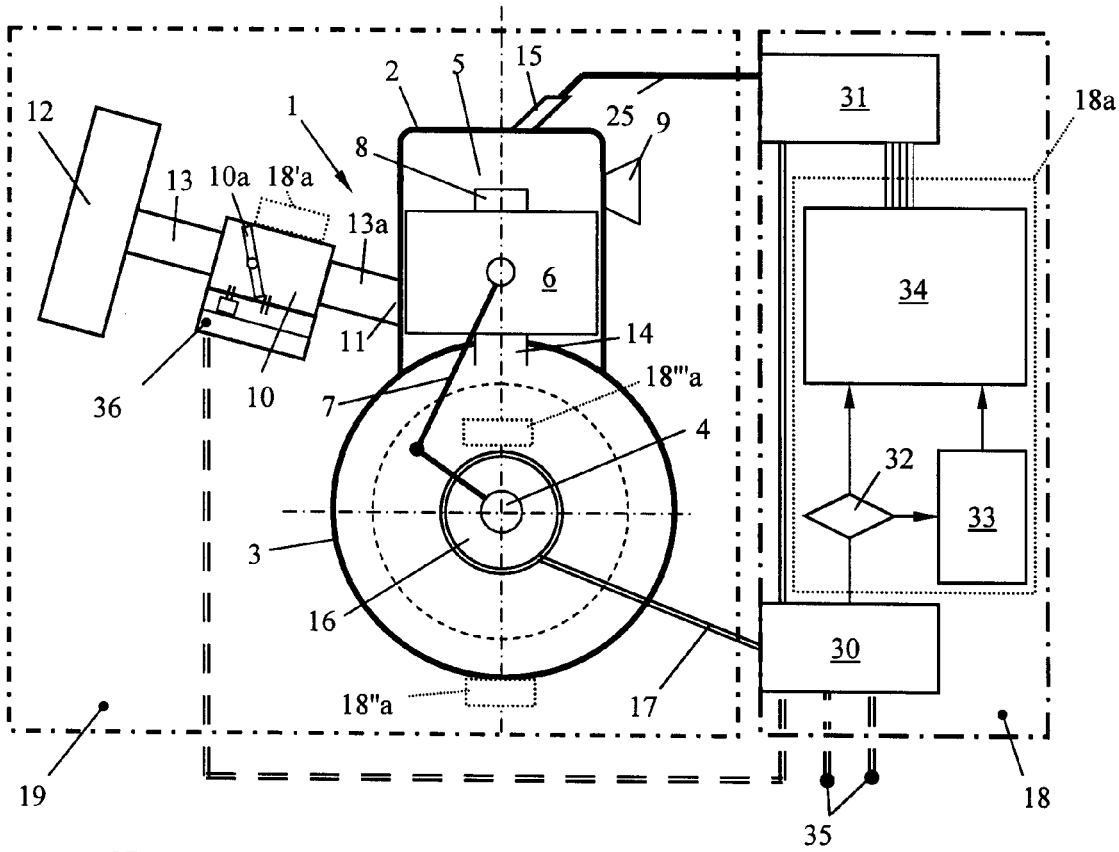
FIG. 1 is a schematic illustration of the motor unit with correlated ignition unit.

The schematic illustration of FIG. 1 shows the motor unit 19 with an internal combustion engine 1 configured in particular as a two-stroke engine. The ignition device according to the invention is not limited to utilization in connection with single-cylinder or multi-cylinder two-stroke engines; it is also utilizable in connection with single-cylinder or multi-cylinder four-stroke engines or similar engines, in particular, reciprocating piston engines.

The internal combustion engine 1 of the motor unit 19 comprises a cylinder 2 with crankcase 3 in which a crankshaft 4 is rotatably supported. In the cylinder 2 a combustion chamber 5 is provided that is delimited by the reciprocating piston 6. The piston 6 is connected by means of connecting rod 7 to the crankshaft 4 in the crankcase 3 and drives the crankshaft 4 in rotation. In the illustrated embodiment, an intake port 8 for the combustion air and/or fuel/air mixture opens into the combustion chamber 5 wherein the intake port 8 is provided at the end of a transfer passage 14 in the wall of the cylinder 2; the other end of the transfer passage 14 opens into the crankcase 3. Moreover, an exhaust 9 is provided through which the combustion gases are exhausted from the combustion chamber 5.

By means of carburetor 10, a fuel/air mixture is supplied to the combustion engine 1 wherein the mixture intake 11 opens into the crankcase 3. The combustion air is taken in through air filter 12 and supplied by means of intake passage 13 and carburetor 10 to the mixture intake 1 1. As the piston 6 moves upwardly, the mixture is conveyed through mixture intake 11 into the crankcase 3 as a result of the vacuum generated in the crankcase 3. As the piston 6 moves downwardly, the mixture sucked into the crankcase 3 is guided by the transfer passage 14 to the intake port 8 and flows into the combustion chamber 5. As the piston 6 moves upwardly again, the intake port 8 and the exhaust 9 are closed off so that the mixture in the combustion chamber 5 will be compressed. The compressed mixture is ignited by spark plug 15. The expanding combustion gases drive the piston 6 downwardly so that the exhaust 9 is opened and the combustion gases are exhausted. The amount of incoming combustion air is controlled by a pivotable throttle valve 10*a* in the carburetor 10.

In the illustrated embodiment, a generator 16 is driven in rotation by the crankshaft 4; the generator 16 is designed as a signal generator and, in particular, as an alternating current generator (alternator) providing electric power for supplying electrical consumers. The induced alternating voltage signals are supplied by a single line 17 to the ignition unit 18. The ignition unit 18 is connected by high-voltage cable 25 to the spark plug 15. The high-voltage cable 25 and the electric line 17 suffice as a connection between the motor unit 19 and the ignition unit 18 for proper function.

It can be expedient to provide the generator with several turns or to provide the coil with different taps for different consumers. Advantageously, at least two coils are provided; the first coil supplies a first consumer and the second coil supplies a second consumer. The electric circuits of the coils can be separate.

The ignition unit 18 is separate from the motor unit 19 and can be mounted as desired at any suitable location of the motor unit 19 or even on the housing of a device that is driven by the motor unit 19. The ignition unit 18 is connected to the generator 16 by means of signal line 17 through which the alternating voltage signal of the generator 16 is supplied. In the ignition unit 18, the alternating voltage signal 18 is processed wherein, on the one hand, an angle information signal is derived and, on the other hand, the signal provides electrical energy for the different electrical consumers such as the ignition unit 18, carburetor heater 36, or other consumers 35.

The alternating voltage signal S (FIG. 3) of the alternating current generator 16 that is preferably continuous across the revolution of the crankshaft is supplied, on the one hand, to an input unit 30 for energy processing and, on the other hand, to a unit 33 for processing angle information. The input unit 30 processes thus the alternating voltage signal S and provides the required electric operating energy to a high-voltage unit 31 which is connected to the spark plug 15 by cable 25. The electric energy of the alternating voltage signal S not only can supply the ignition unit 18 itself with the required energy but, advantageously, the carburetor heater 36 at the carburetor 10 can also be powered by means of a consumer supply line. By connectors 35 further internal or external consumers such as a laser positioner or a lamp can be connected; it is even possible to recharge an energy storage device such as a rechargeable battery e.g. for as a power supply for the ignition unit 18. On the other hand, the input unit 30 processes the alternating voltage signal S to an angle information signal W (FIG. 6) which, by a decision diamond 32, is supplied to an evaluation unit 33 or directly to an ignition timing control unit 34. The ignition timing control unit 34 is comprised advantageously of a microprocessor with appropriate peripheral components. The output signal of the evaluation unit 33 is supplied also to the ignition timing control unit 34. The ignition timing control unit 34 controls the high-voltage unit 31 in order to trigger at a precise angle an ignition spark at the spark plug 15. By means of the control other functions can be operated also, for example, an injection valve of a fuel injection device or other mechatronic components.

Figure 2:
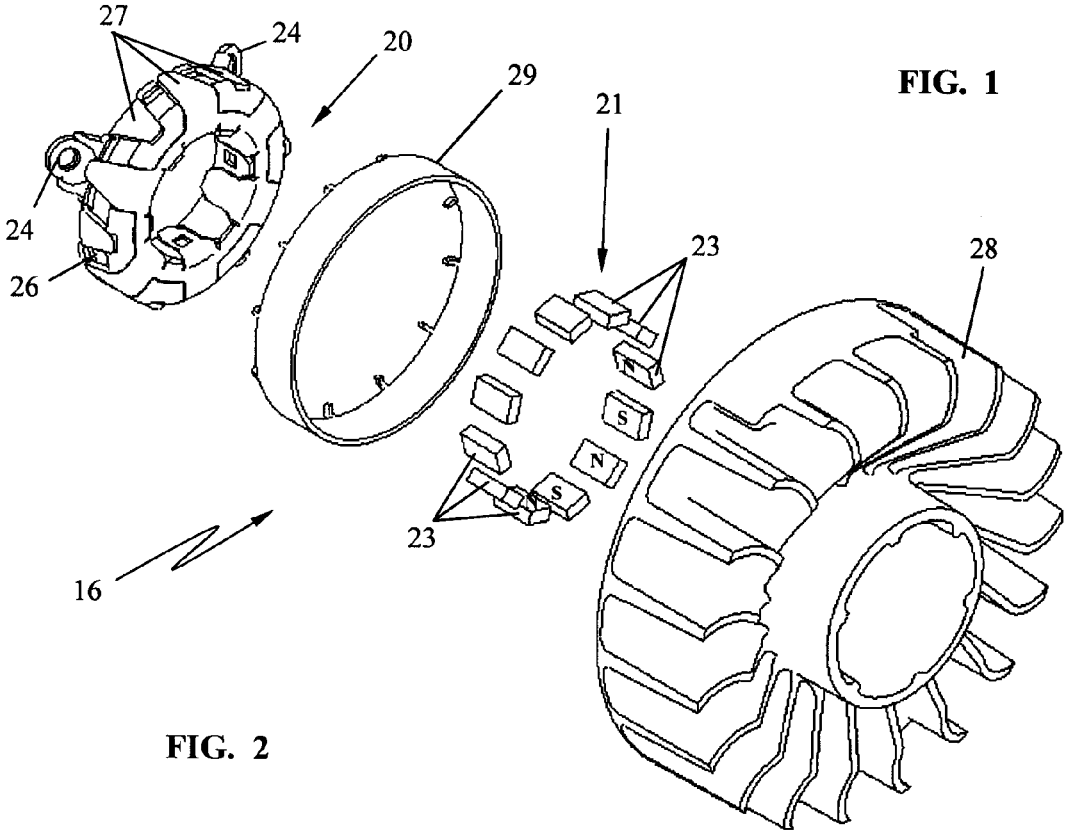
FIG. 2 is a schematic illustration of an alternating current generator (alternator) driven by the crankshaft of the internal combustion engine of the motor unit, wherein the alternator as a claw pole alternator.

The alternating current generator 16 employed in the motor unit 19 is advantageously a so-called claw pole alternator as schematically illustrated in FIG. 2. It is comprised essentially of a coil body 20 which is secured by fastening tabs 24 stationarily to the crankcase 3. The coil 26 is surrounded by a total of 12 claws 27 wherein the claws 27 alternatingly engage the coil from one or the other end face of the coil 26. The claws 27 form part of a magnetic circuit for alternating magnetic flux.

Figure 3:
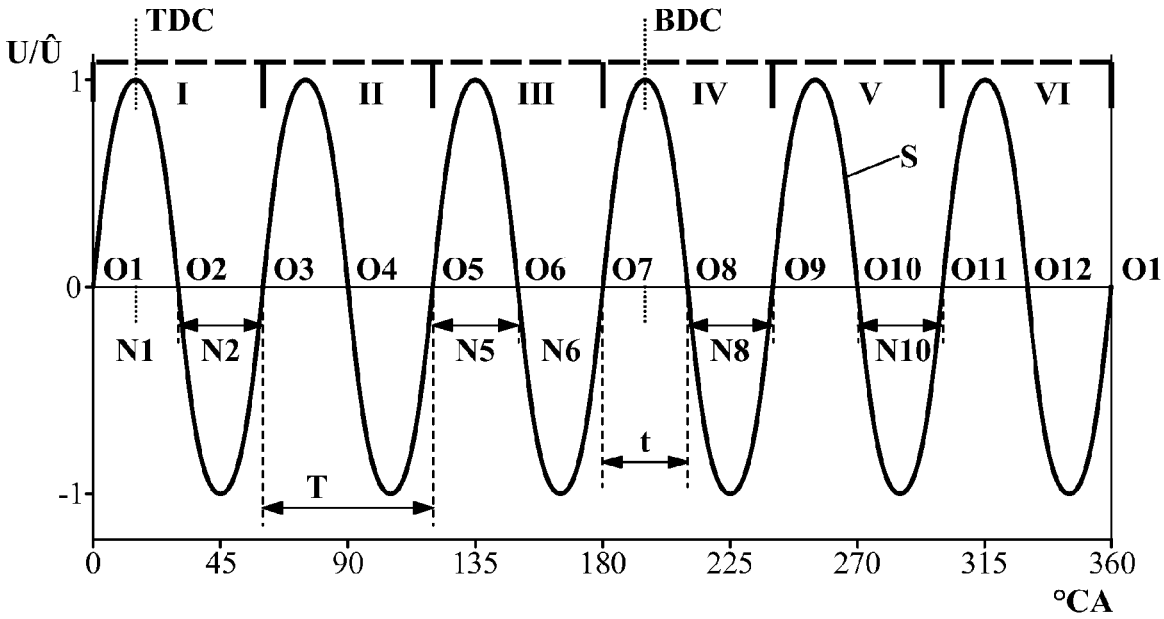
FIG. 3 shows an idealized voltage course of a multi-pole alternating current generator (alternator) plotted against the crankshaft angle.

In the illustrated embodiment, the rotor 21 is integrated into a fan wheel 28 that is secured fixedly to the end of the crankshaft 4 and rotates with the crankshaft 4. The rotor is comprised of an annular arrangement 21 of 12 permanent magnets 23 that are arranged with alternating poles N, S about the circumference of the rotor in uniform distribution. For this purpose, a support ring 29 is provided that can be configured as a magnetic yoke (magnetic return element). As a result of the alternating polarity of the adjacently arranged permanent magnets 23 upon rotation of the rotor, an alternating magnetic flux will penetrate the coil 26 of the coil body 20 and this causes the correspondingly induced alternating voltage signals that are supplied by line 17 to the input unit 30 of the ignition unit 18. When mounting the coil body 20 on the crankcase 3 of the internal combustion engine 1, it can be expedient to orient the angle position of the coil body 20 as a stator in such a way that the induced voltage has a zero crossing when, for example, the exhaust 9 is opened, the piston 6 is at top dead center, or the intake 8 is opened. An idealized voltage course of an alternating current generator according to FIG. 2 is illustrated in FIG. 3. The voltage is illustrated as a standardized voltage $U/\hat{U}$ and plotted against the angle position of the crankshaft, i.e., against the crank angle ° CA.

The constructive configuration of the alternating current generator 16 is matched such to the crankshaft revolution that the period duration T of the alternating voltage signal S corresponds to the n-th portion of a crankshaft revolution. In the illustrated embodiment according to FIG. 3, n is preferably an integer greater 2. Preferably, the number n is in the range from 5 to 8, in particular in the range from 4 to 7. In the illustrated embodiment, the number n is selected to be 6. It can be expedient to select greater numbers up to maximally 12 or even greater so that the number of zero crossings for a crankshaft revolution is greater.

When the period duration T is selected to be one sixth of a crankshaft revolution, the period duration T corresponds to 60° CA. Accordingly, one revolution of the crankshaft (360° CA) is divided into six crankshaft intervals I, II, III, IV, V, VI as indicated in the bar at the top of FIG. 3 and as illustrated in FIG. 4 as a circle diagram.

Two claws 27 each of the stator or coil body 20 effect with two permanent magnets 23, respectively, a complete alternating voltage wave with positive and negative half wave wherein the alternating voltage waves follow one another without gap. In this way, a continuous curve in accordance with FIG. 3 results. For a division into six crankshaft intervals I to VI, there are thus 12 zero crossings $O_i$ of the alternating voltage signal S. Accordingly, 12 zero crossing intervals $N_i$—for example, $N_1$, $N_2$, $N_3$ etc.—can be defined. Each zero position interval $N_i$ is delimited by two sequential, preferably neighboring, zero crossings $O_i$ and $O_{i+1}$ of the alternating voltage signal S. This sequence of zero crossings $O_i$ corresponds to an angle information signal W (FIG. 6) that is processed in the input unit 30 of the ignition unit 18. For each zero crossing interval $N_i$ an interval engine speed $n_i$ is calculated in the input unit 30 so that each zero crossing interval $N_i$ has correlated therewith an interval engine speed $n_i$.

Figure 4:
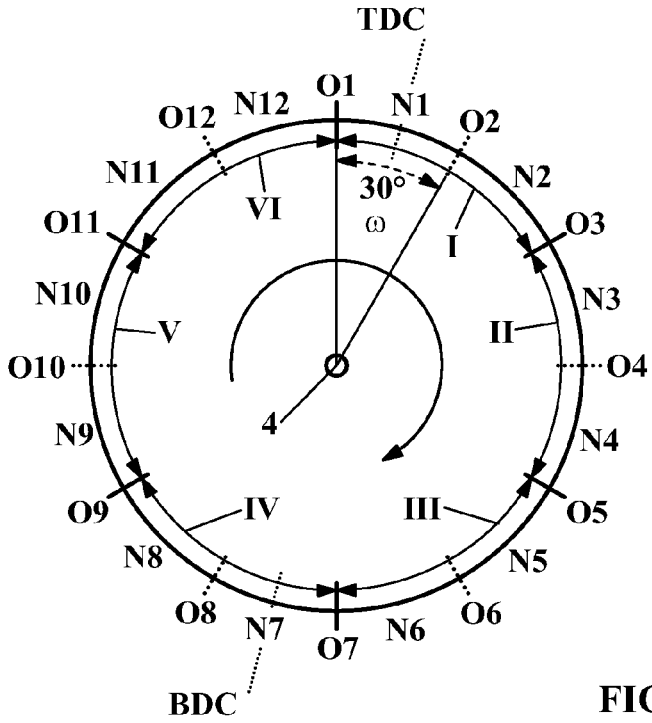
FIG. 4 is a schematic illustration of one crankshaft revolution with correlation of the zero crossings of the voltage signal according to FIG. 3.

In FIG. 4, the correlation of the respective crankshaft angle intervals I to VI or zero crossing intervals N1 to N12 is illustrated as well as the zero crossings O1 to O12. FIG. 4 illustrates that the spacing of two zero crossings, for example, O1 and O2, is precisely 30° crank angle; based on this relation the angular speed ω of the crankshaft 4 at the respective zero position interval $N_i$ can be derived. The zero crossings $O_i$ are therefore positioned in uniform distribution across a crankshaft revolution. It can be sufficient to evaluate the alternating voltage signal only for a portion of the crankshaft revolution, for example, between 120° CA before TDC to 120° CA after TDC. It would then also be sufficient to mount a generator in such a way that only across this area an alternating voltage signal is generated.

The constructive correlation of the stator and rotor can be advantageously chosen such that the top dead center TDC of the piston follows immediately a zero crossing $O_i$, preferably approximately 15° CA after TDC. In this connection, it can be expedient to provide top dead center TDC near or at the maximum of the signal S. Correspondingly, bottom dead center BDC of the piston is then approximately at 195° CA.

Figure 5:
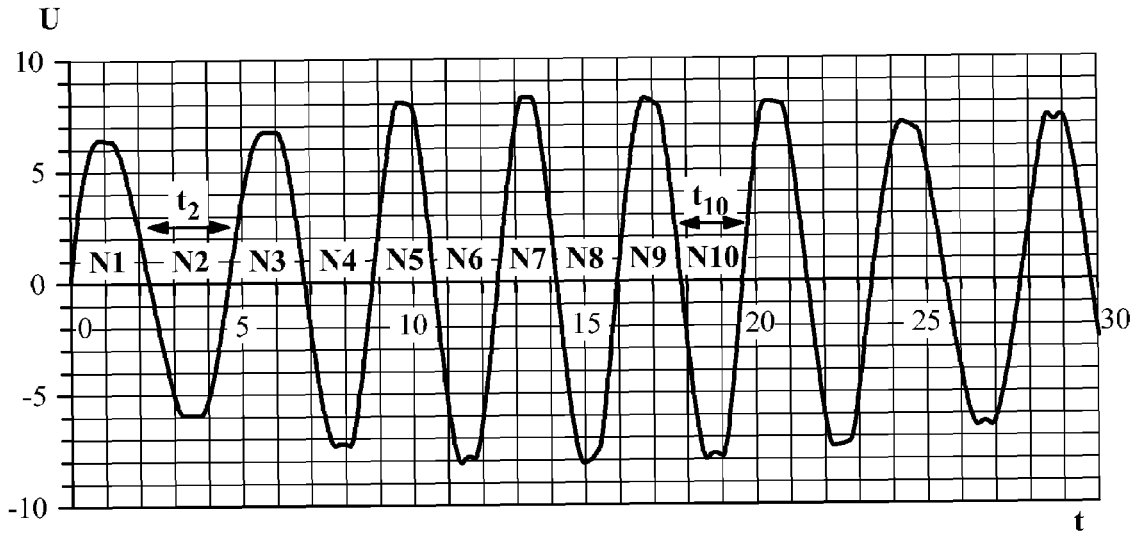
FIG. 5 is a real alternating voltage signal of an alternating current generator (alternator) according to FIG. 2.

In FIG. 5, the voltage signal U of the alternating voltage generator 16 in operation of the internal combustion engine 1 is plotted against the time t. The voltage amplitude and the spacings of the zero crossings are proportional to the engine speed n. The zero crossings $N_1$ to $N_{12}$ are approximately load-independent so that the zero position intervals provide directly a suitable parameter for the engine speed. In order to further prevent a possible load effect on the position of the zero crossings $O_i$ it can be expedient to power off principally an electrical load connected to the alternator 16 in the area of a zero crossing $O_i$; the load is supplied with power from the alternator only in the interval between two zero crossings. As a result of the alternator being thus load-free, possible inductive and capacitive signal displacements are eliminated. The interruption of the current flow in a range from approximately 5° CA before the expected zero crossing $O_i$ to approximately 1° CA after this zero crossing $O_i$ has been found to be expedient.

Figure 6:
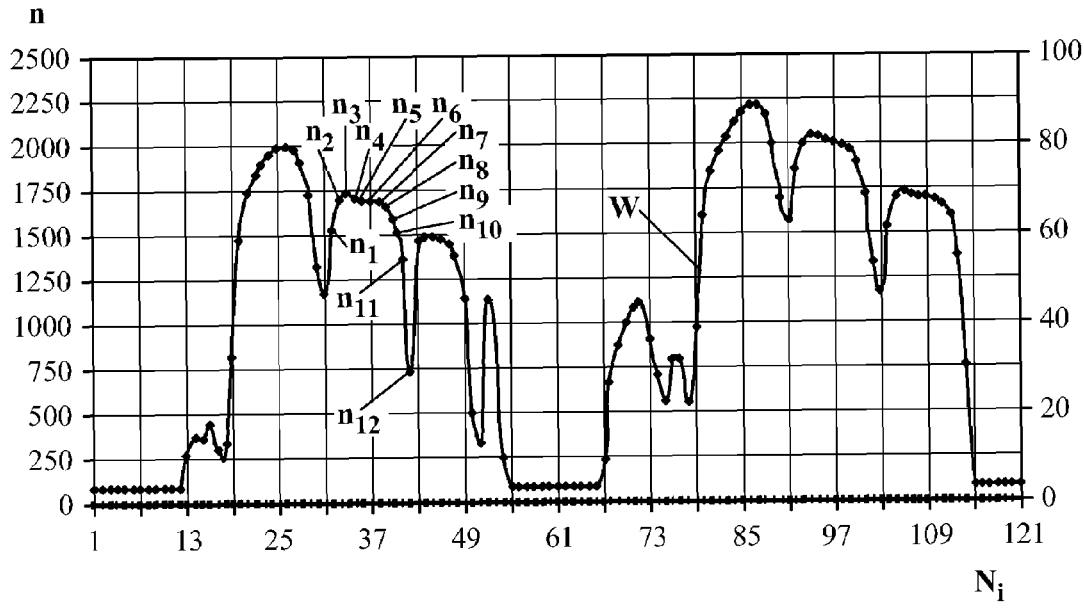
FIG. 6 shows the engine speed course generated based on interval engine speeds of an alternating current generator (alternator) driven by an internal combustion engine.
Figure 7:
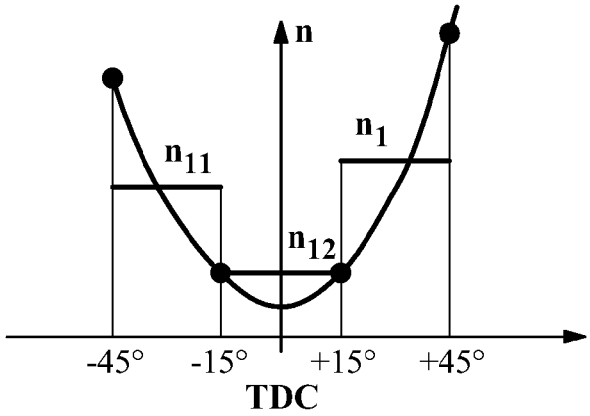
FIG. 7 is a schematic illustration regarding the rotational position of the alternating current generator (alternator) relative to an engine speed minimum.

When the interval engine speeds $n_i$ are plotted against the intervals $N_i$, for an engine start, an engine speed course according to FIG. 6 results. In FIG. 6, the calculated interval engine speeds $n_1$ to $n_{12}$ are illustrated for one crankshaft revolution.

The engine speed course of the interval engine speeds provides the angle information signal W based on which an angle-precise correlation of the mechanical crankshaft position to the alternating voltage signal S can be realized. Across the number of angle intervals $N_i$ the engine speed course of the internal combustion engine 1 is very characteristic. When looking at the engine speed course W across at least one complete revolution of the crankshaft 4, it is possible to filter out different characteristic features wherein a characteristic feature can be correlated to an operating parameter of the internal combustion 1. Based on the engine speed course of the determined interval engine speeds $n_i$ in connection with the known constructive features of the internal combustion engine 1 a simplified determination of the crankshaft angle position can be performed. Independent of the actual angle position ° CA of the crankshaft 4 as the crankshaft begins to rotate, the engine speed course W of the interval engine speeds $n_i$ is evaluated in order to determine the actual mechanical crankshaft angle position. This is possible already during the first crankshaft revolution because the characteristic features of the engine speed course, for example, as a result of compression in the area of the top dead center, opening of the exhaust 9, or opening of the transfer passages 14, are pronounced within a fixedly assigned zero position intervals $n_i$. With one and the same engine speed course, several different operating parameters of the internal combustion engine 1 can be determined.

In order to achieve an angle-precise correlation of the alternating engine signal S to the mechanical crankshaft angle position, according to a first embodiment of the invention the engine speed course W of the interval engine speeds $n_i$ is scanned with regard to a pronounced engine speed minimum $n_{12}$ wherein the crankshaft angle position corresponds approximately to the position of the piston 6 at top dead center TDC within the corresponding crankshaft angle interval $N_{12}$ of the engine speed minimum $n_{12}$. For a quick and precise determination of the actual mechanical angle position of the crankshaft the polarity of the voltage signal S in the crankshaft angle interval $N_{12}$ can be evaluated additionally. Relative to the idealized illustration in FIG. 3, the zero position intervals $N_1$ to $N_{12}$ can be easily differentiated by the control electronics of the ignition unit 18 because the zero position intervals $N_1$, $N_3$, $N_5$, $N_7$, $N_9$, and $N_{11}$ have a positive half wave and the other zero positions $N_2$, $N_4$, $N_6$, $N_8$, $N_{10}$, and $N_{12}$ have a negative half wave.

Moreover, when the angle position of the alternating current generator 16, i.e., in the embodiment according to FIG. 2 the angle position of the coil body 20 forming the stator, is selected such that the zero crossing $O_{12}$ of the voltage signal S is at top dead center of the piston 6, a substantially unequivocal correlation between the zero crossings $N_i$ and the mechanical crankshaft angle position is possible.

It can be expedient to adjust the angle position of the stator 20 such that the crankshaft angle interval $N_{12}$ of the engine speed minimum $n_{12}$ is symmetric to the top dead center so that by simple comparison of the neighboring interval engine speeds $n_{11}$ and $n_1$ the engine speed minimum can be determined without great computational expenditure. The following applies:

$$n_{11}>n_{12}<n_1.$$

When for a start of the engine beneficial conditions for a fast correlation of the alternating voltage signal S to the crankshaft are to be provided, it is advantageous to adjust the rotational orientation of the stator to the rotor such that a zero crossing $O_i$ of the voltage signal S is immediately before top dead center TDC of the piston, preferably approximately 15° CA before TDC.

Figure 8:
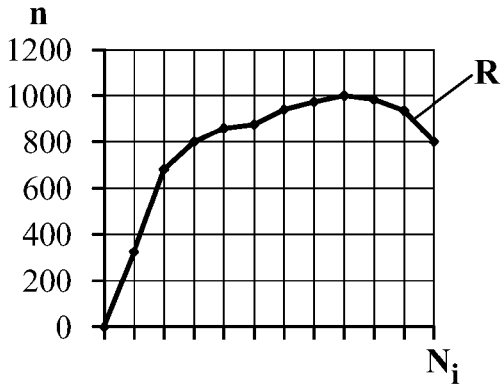
FIG. 8 shows a reference curve for a motor-typical engine speed course during engine start.
Figure 9:
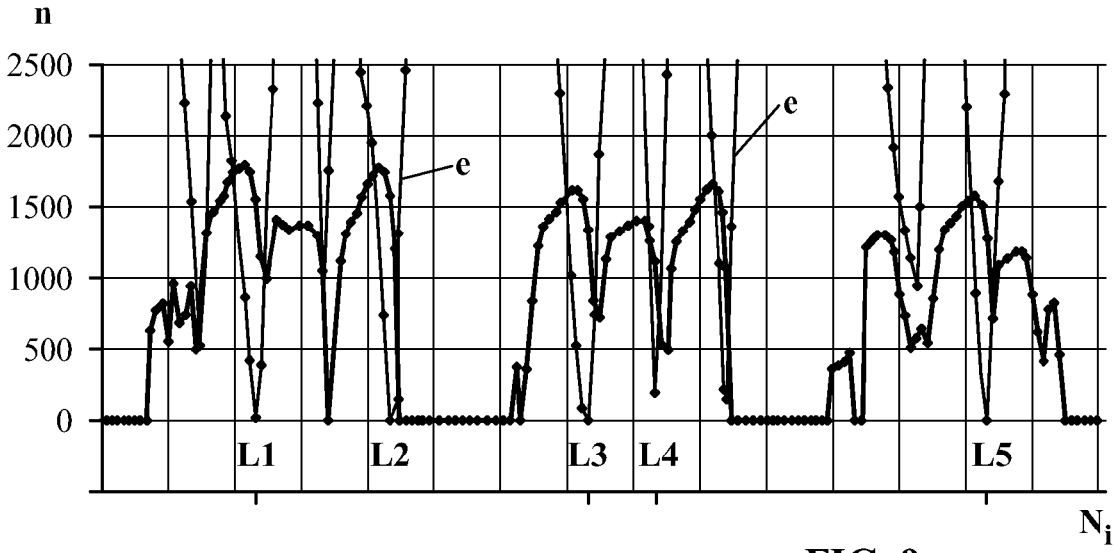
FIG. 9 shows the engine speed course of an internal combustion engine during engine start with superposition of a sum check error relative to the reference curve according to FIG. 8.

The engine start of an internal combustion engine 1 according to FIG. 1 also exhibits a characteristic engine speed acceleration which occurs always at the same spacings to the zero position intervals $N_i$. When, based on a plurality of engine starts, a reference curve R according to FIG. 8 is determined, the actual mechanical crankshaft angle position can be recognized based on the reference curve R in a simple way. For this purpose, the determined interval engine speeds are standardized ($n_{standard}$) and compared to the reference engine speed $n_{ref}$ of the corresponding interval $N_i$ of the reference curve R. The difference between the standardized interval engine speeds $n_{standard}(i)-n_{ref}(i)$ is used for calculation of a sum check error. The calculated sum check error is substantially zero when real engine speed course and reference curve are similar or coincide. In FIG. 9, the position of the piston 6 and thus the angle position of the crankshaft 4 in the intervals $L_1$, $L_2$, $L_3$, $L_4$, and $L_5$ is therefore detected safely in that the sum check error is approximately 0. Accordingly, the ignition timing control 34 can trigger ignition at the point in time when the sum check error is approximately 0.

Figure 10:
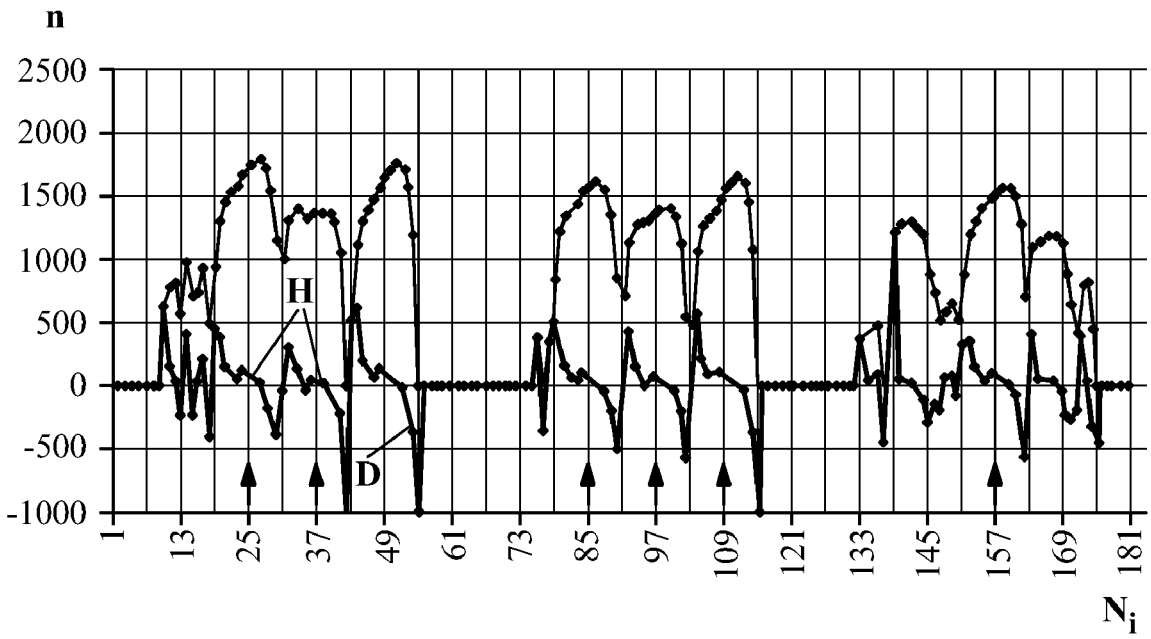
FIG. 10 shows the engine speed course of an internal combustion engine during engine start with superposition of a differential engine speed course D.

According to a further embodiment of the invention the engine speed course W can be illustrated by differentiation in accordance with FIG. 10 as the differential curve D. Advantageously, this is not a mathematical differentiation because this would be mathematically very complex. In approximation, the same result will be obtained when the engine speed change for each zero position interval is evaluated. The following applies:

$$n = \frac{\Delta\alpha}{\Delta t} \Rightarrow n' = \Delta n(i \rightarrow i+1)$$

Since a zero position interval extends across 30° CA, Δt is determined by measuring the time. The thus obtained differential curve D has in the correlated interval of the crank angle CA a characteristic hook H that enables an unequivocal correlation of the crank angle. When the ignition unit 18 has assigned to the alternating voltage signal S an unequivocal mechanical crankshaft angle position, it is possible to follow the actual crankshaft angle position by simply counting the zero crossings. A further evaluation of the engine speed course W itself is no longer needed. The electric alternating voltage signal S is angle-precisely correlated with the actual mechanical crank angle position. The signal is angle-precisely locked. At any zero crossing $O_i$ the ignition unit 18 knows the actual mechanical crankshaft angle position (crank angle) so that the processed angle information signal W of the decision diamond 37 can be directly supplied to the ignition timing control unit 34. An evaluation of the angle information signal W for the purpose of correlation (locking) of the alternating voltage signal S to the actual mechanical crankshaft angle position in the evaluation unit 33 is no longer needed. According to a further feature of the invention, an extrapolation of the crankshaft angle position is performed between two zero crossings wherein this is based on a zero crossing $O_i$. was found that until the next zero crossing $O_{i+1}$ is reached, there will be angular errors but these errors are within approximately 1° crank angle and can be reset to zero when reaching the next zero crossing $O_{i+1}$. The direction of the angular error of the extrapolation provides information in regard to compression or expansion wherein a maximal error occurs after complete combustion, i.e., at a point in time in which the delay (due to compression) changes to acceleration (due to combustion).

Figure 11:
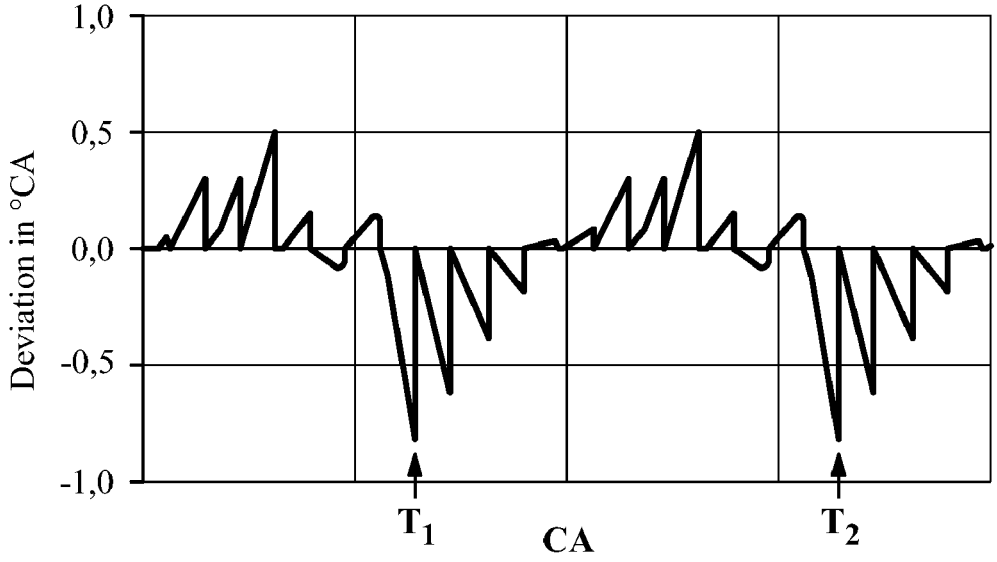
FIG. 11 shows the course of the angle error of the crankshaft position upon extrapolation of the angle position of the crankshaft from one zero position to the next zero position.

FIG. 11 shows that the angular error is clearly pronounced and allows for correlation to a crankshaft angle interval in the area of the top dead center TDC of the piston 6, i.e., at the time $T_1$ and $T_2$.

In order to more precisely determine the actual angle position of the crankshaft, the angle position of the alternating current generator 16, i.e., the rotary angle position of the stator 20, can be advantageously provided such that a zero crossing $O_i$ of the voltage signal S is located at an angle position of the crankshaft 4 that is approximately before the ignition timing range of approximately 40° CA, in particular 15° CA, before TDC. Preferably, the rotational orientation between the stator and the rotor of the alternating current generator 16 is adjusted such that a voltage maximum, especially a positive one, is at top dead center TDC of the piston. In a different configuration, a zero crossing $O_i$ directly before the ignition timing range of the internal combustion engine can be expedient.

In a further embodiment of the invention, the ignition unit 18 is comprised of separate modules 18*a*, 31 that are individual components. One module is comprised of an electronic control unit 18*a* such as a microprocessor or a similar device and the other module is comprised of the high-voltage unit 31. In this way, the control unit 18*a* can arranged separate from the high-voltage unit 31 in a thermally advantageous area of the power tool. An arrangement on or near a component of the motor unit 19 is expedient. In this way, the control unit 18'*a* can be arranged at the mixture processing device, for example, the carburetor 10. The motor unit 19 is expediently connected together with the carburetor 10 by antivibration elements in the housing of a power tool wherein the carburetor 10 is advantageously connected by means of an elastic passage 13 resiliently to the internal combustion engine 1. An arrangement of the control unit 18'*a* directly on the housing of the carburetor 10 has the advantage of an effective vibration decoupling because the carburetor 10 by means of the antivibration elements is decoupled from the housing of the power tool and is also vibration-decoupled from the internal combustion engine 1 because of the elastic connection to the internal combustion engine 1. In this way, a vibration-decoupled arrangement of the electronic control unit 18'*a* is obtained without the electric connecting lines to the high-voltage unit 31 or to the generator 16 having to be passed across an antivibration gap. A thermally advantageous arrangement for the control unit 18'*a* is provided which is also vibration-resistant and soiling-resistant.

Alternatively, the control unit 18"*a* can also be arranged on or near the crankcase 3, for example, near the generator 16 underneath the cylinder 2. An advantageous position is also provided for the control unit 18"*a* when it is arranged on the part of the crankcase 3 that is facing away from the cylinder 2, i.e., at the bottom of the crankcase 3 as shown in FIG. 1.

Figure 12:
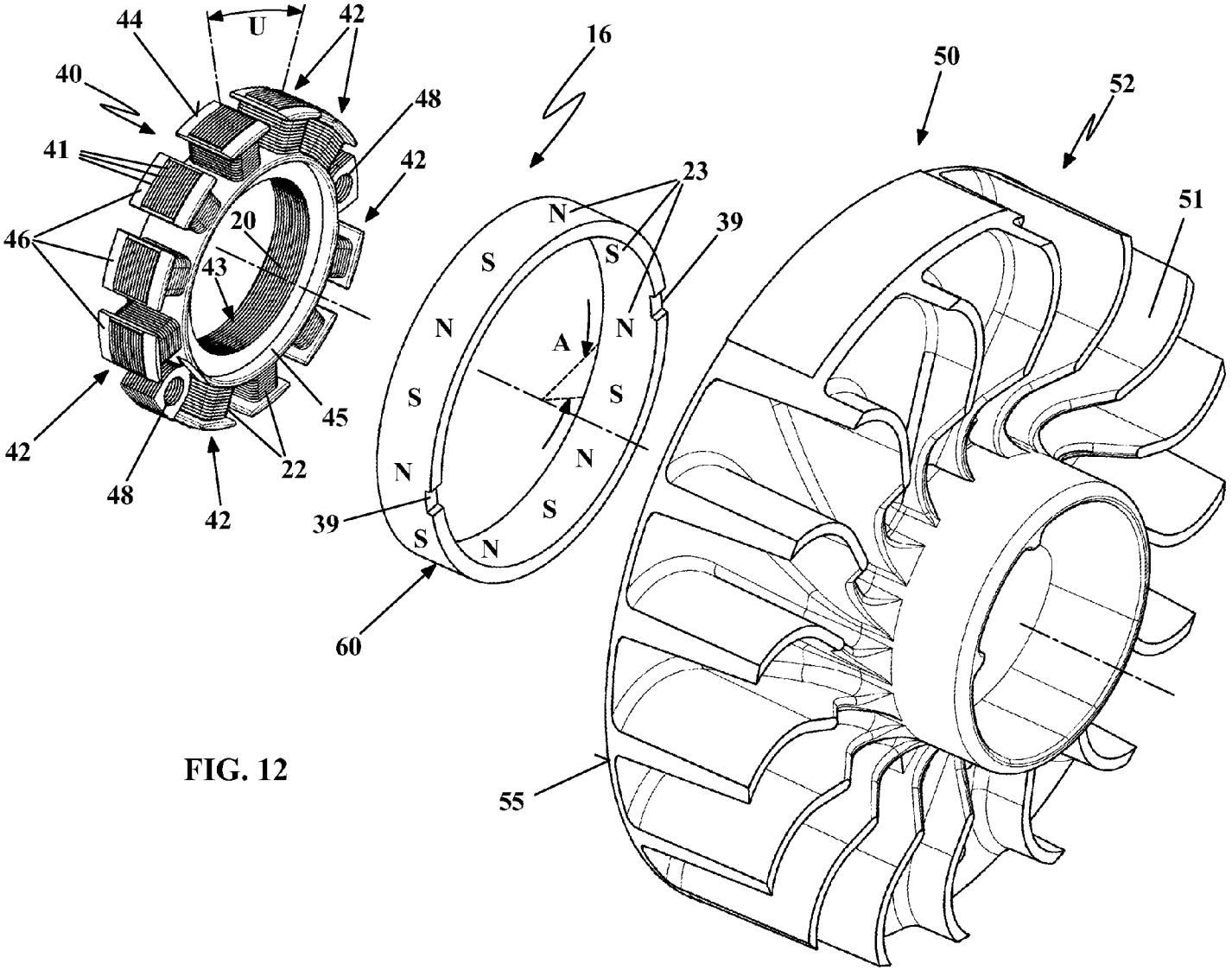
FIG. 12 schematically shows an alternator embodied as a radial alternator.

In the embodiment according to FIG. 12, the alternator 16 is configured as a radial alternator, i.e., an alternator 16 with poles 42 that are oriented radially in a star shape. The coil support 20 of the stator 40 is comprised of a lamination pack of individual sheet metal laminations 41 wherein the individual laminations 41 are stacked axially. The lamination pack has individual post-shaped coil supports that extend radial outwardly to the outer circumference 44. The posts form individual poles 42 and serve as supports of induction coils 22 of which at least one is arranged on each of the post-shaped poles 42. In the illustrated embodiment a total of twelve posts are provided that are spaced relative to one another in the circumferential direction at an identical spacing U of preferably 30°.

For attaching the stator 40, two axial fastening openings 48 are provided in two of the posts that are positioned approximately opposite one another; the fastening openings 48 penetrate the sheet metal laminations 41 and are provided for receiving fastening screws with which the stator 40 is fixedly mounted, for example, on the crankcase 3 (FIG. 1). The posts with the fastening openings 48 have no coil. The stator 40 is advantageously embedded (potted) for which purpose a cylindrical base plate 45 is attached to the base of the post-shaped poles 42; this base plate 45 projects axially past the end faces of the lamination pack. Accordingly, the free ends of the posts support end plates 46 whose axial length corresponds to the axial height of the cylindrical base plate 45. The space between the base plate 45 and the end plates 46 is filled with a potting compound or the like. In this way, the coils are secured on the individual post-shaped poles 42 and secured against mechanical damage.

The position of the posts with the fastening openings 48 is selected such that, in the circumferential direction, on one side four poles 42 and on the other side six poles 42 are positioned between them. The summation signal of the coils 22 connected to one another corresponds to the alternating signal S as illustrated in FIG. 3.

The rotor 52, as in the embodiment according to FIG. 2, is comprised of a wheel member 50 that, in the illustrated embodiment is a fan wheel 51 of an internal combustion engine. On the side facing the stator 40, a receiving cup 55 is formed on the fan wheel 51 into which a magnet ring 60 is inserted that, in the circumferential direction, is magnetized alternatingly as a north pole N and a south pole S at identical spacings A to one another. In this way, about the circumference twelve permanent magnets 23 are created. For ensuring a correct rotational position of the magnet ring 60 in the receiving cup 55 of the rotor 52, locking grooves 39 are provided at one end face. The position of the magnet ring 60 relative to the position of the crankshaft is determined by means of these locking grooves 39.

In the mounted state, the inner circumference of the unitary magnet ring 60 is positioned at a minimal spacing about the outer circumference 44 of the stator 40. The stator 40 is positioned completely within or inside the magnet ring 60. When the rotor 52 rotates, the alternating magnetization of the magnet ring 60 causes alternating flux in the poles 42 so that an alternating voltage signal S is induced as illustrated in FIGS. 3 and 5.

The specification incorporates by reference the entire disclosure of German priority document 10 2006 038 276.5 having a filing date of 16 Aug. 2006.

While specific embodiments of the invention have been shown and described in detail to illustrate the inventive principles, it will be understood that the invention may be embodied otherwise without departing from such principles.

What is claimed is:

1. An ignition device for a motor unit comprising an internal combustion engine, wherein the internal combustion engine of the motor unit comprises a piston, a combustion chamber with a spark plug, a crankshaft that is driven in rotation by the piston, an intake port for supplying combustion air into the combustion chamber, an exhaust for removing combustion gases from the combustion chamber, an alternator that is driven in rotation by the crankshaft and attached to the motor unit, wherein the alternator supplies electric energy to electric consumers and, for one crankshaft revolution, emits sequential alternating voltage signals; the ignition device comprising:

an ignition unit that triggers a spark at the spark plug at a preselectable timing;

wherein the ignition unit is a module that is separate from the motor unit;

wherein an electric alternating voltage signal generated by the alternator is supplied by a single line to the ignition unit; and wherein the ignition unit comprises a first unit for energy processing and a second unit for processing information for control of the internal combustion engine, wherein the alternating voltage signal is supplied to said first and second units;

wherein an angle information signal that angle-precisely correlates a mechanical crankshaft angle position to the alternating voltage signal is derived from the alternating voltage signal as an information signal sufficient for operating the internal combustion engine.

2. The ignition device according to claim 1, wherein only the electric alternating voltage signal is supplied as said information signal sufficient for operating the internal combustion engine.

3. The ignition device according to claim 1, wherein said angle information signal is scanned for a characteristic feature and the characteristic feature is correlated with a known mechanical angle position of the crankshaft.

4. The ignition device according to claim 1, wherein said angle information signal is comprised of sequential zero crossings of the alternating voltage signal.

5. The ignition device according to claim 4, wherein the zero crossings are uniformly distributed across a crankshaft revolution.

6. The ignition device according to claim 4, wherein a spacing between two zero crossings defines a zero position interval, respectively, and wherein for each zero position interval an interval engine speed is determined, wherein the interval engine speeds represent an engine speed course that defines said angle information signal.

7. The ignition device according to claim 6, wherein the engine speed course is determined across at least one complete revolution of the crankshaft.

8. The ignition device according to claim 6, wherein the zero position interval corresponds to an n-th portion of the crankshaft revolution, wherein n is an integer greater than 6.

9. The ignition device according to claim 7, wherein n is between 6 and 24.

10. The ignition device according to claim 7, wherein n is 12.

11. The ignition device according to claim 6, wherein the angle position of the signal generator on the motor unit and the top dead center of the piston are adjusted relative to one another such that one of the zero position intervals is symmetric to the top dead center of the piston.

12. The ignition device according to claim 6, wherein the angle position of the signal generator on the motor unit and the top dead center of the piston are adjusted relative to one another such that a zero crossing of the alternating voltage signal is approximately 15° CA before the top dead center of the piston.

13. The ignition device according to claim 6, wherein the engine speed course is differentiated to a differential curve and wherein, in the differential curve, a zero position interval having a characteristic hook is correlated with a characteristic mechanical crankshaft angle position.

14. The ignition device according to claim 1, wherein the angle position of the signal generator is selected such that a zero crossing of the alternating voltage signal is approximately at an angle position of the crankshaft before the ignition timing range.

15. The ignition device according to claim 14, wherein said angle position of the crankshaft is immediately before the ignition timing range.

16. The ignition device according to claim 1, wherein the signal generator is a claw pole alternator or a radial alternator.

17. The ignition device according to claim 16, wherein a stator of the alternator is secured on the crankcase and wherein the rotor supporting magnets is connected to a fan wheel of the internal combustion engine.

18. The ignition device according to claim 1, wherein energy of the alternating voltage signal is supplied to an electric consumer.

19. The ignition device according to claim 18, wherein the electric consumer is a high-voltage unit of the ignition device, a heater, or a light source.

20. The ignition device according to claim 18, wherein a current flow to the electric consumer is stopped in the area of the zero crossing of the alternating voltage signal.

21. The ignition device according to claim 18, wherein a current flow to the electric consumer is stopped in an angle range of from approximately 5° CA before a zero crossing of the altering voltage to approximately 1° CA after said zero crossing.

22. The ignition device according to claim 1, wherein the ignition unit is comprised of a control unit and a separate high-voltage unit.

23. The ignition device according to claim 22, wherein the control unit is a microprocessor.

24. The ignition device according to claim 22, wherein the control unit is mounted separate from the high-voltage unit in an area of a power tool in which the motor unit is arranged, which area is exposed to low thermal load.

25. The ignition device according to claim 22, wherein the control unit is arranged on or near a component of the motor unit.

26. The ignition device according to claim 25, wherein the component of the motor unit is a mixture processing device or the crankcase.

27. The ignition device according to claim 26, wherein the mixture processing device is the carburetor.

28. The ignition device according to claim 26, wherein the control unit is mounted on the crankcase at a location remote from the cylinder.

29. A method for processing an alternating voltage signal in an ignition device for a motor unit comprising an internal combustion engine, wherein the internal combustion engine of the motor unit comprises a piston, a combustion chamber with a spark plug, a crankshaft that is driven in rotation by the piston, an intake port for supplying combustion air into the combustion chamber, an exhaust for removing combustion gases from the combustion chamber, a signal generator driven in rotation by the crankshaft and attached to the motor unit and, for one crankshaft revolution, emitting sequential alternating voltage signals, wherein the ignition device comprises an ignition unit that triggers a spark at the spark plug at a preselectable timing; wherein the ignition unit is a module that is separate from the motor unit; wherein an electric alternating voltage signal generated by the signal generator is supplied to the ignition unit as an information signal sufficient for operating the internal combustion engine; and wherein the ignition unit comprises a first unit for energy processing and a second unit for processing information for control of the internal combustion engine, wherein the alternating voltage signal is supplied to said first and second units, wherein the alternating voltage signal that is produced by the signal generator is processed to an angle information signal correlated angle-precisely to the rotating shaft, the method comprising the step of:

configuring the signal generator such that a constructively predefined spacing between zero crossings of the alternating voltage signal corresponds to an n-th portion of a complete shaft revolution, wherein n is an integer;

detecting a time interval between sequential zero positions;

determining an interval engine speed for a zero position interval of sequential zero crossings;

plotting the engine speed values of the interval engine speeds against the crank angle so that an engine speed course is provided that is an angle information signal for the mechanical angle position of the shaft.

30. The method according to claim 29, comprising the step of determining the zero crossings in a load-free state of the signal generator.

31. The method according to claim 30, wherein a current flow to an electrical load connected to the signal generator is stopped at the time of a zero crossing of the alternating voltage signal.

32. The method according to claim 31, wherein the current flow is stopped for a duration of passing from approximately 5° CA before said zero crossing to approximately 1° CA after said zero crossing.

33. The method according to claim 29, further comprising the step of scanning the engine speed course for an engine speed minimum, wherein the angle position at the top dead center of the piston is correlated with the engine speed minimum.

34. The method according to claim 33, further comprising the step of comparing the engine speed course to a reference curve and, when the engine speed course and the reference curve coincide substantially, correlating a concrete angle value of the reference curve with the angle position of the engine speed curve.

35. The method according to claim 34, further comprising the steps of differentiating the engine speed course to a differential curve and comparing the differential curve to a reference curve.

36. The method according to claim 35, wherein the step of comparing is carried out by sum check error determination.

37. The method according to claim 29, wherein an actual mechanical crankshaft angle position between two zero crossings of the alternating voltage signal is determined by extrapolation.

* * * * *